US008936493B2

(12) United States Patent
Fan et al.

(10) Patent No.: US 8,936,493 B2
(45) Date of Patent: Jan. 20, 2015

(54) ELECTRICAL CONNECTOR WITH SPACER

(71) Applicant: Hon Hai Precision Industry Co., Ltd., New Taipei (TW)

(72) Inventors: Ding-Bing Fan, Kunshan (CN); Hong-Qiang Han, Kunshan (CN); Hao Zhou, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 52 days.

(21) Appl. No.: 13/902,983

(22) Filed: May 28, 2013

(65) Prior Publication Data

US 2013/0316590 A1 Nov. 28, 2013

(30) Foreign Application Priority Data

May 25, 2012 (CN) ..... 2012 2 0239527

(51) Int. Cl.

| | |
|---|---|
| ***H01R 24/00*** | (2011.01) |
| ***H01R 13/514*** | (2006.01) |
| ***H01R 12/72*** | (2011.01) |
| ***H01R 13/502*** | (2006.01) |

(52) U.S. Cl.

CPC ..... *H01R 13/514* (2013.01); *H01R 12/724* (2013.01); *H01R 13/502* (2013.01)

USPC ..... 439/660

(58) Field of Classification Search

USPC ..... 439/656, 660, 607.01, 541.5, 607.23, 439/489, 108, 638–639

See application file for complete search history.

(56) References Cited

U.S. PATENT DOCUMENTS

| | | | | |
|---|---|---|---|---|
| 7,232,346 | B2 * | 6/2007 | Hu et al. | 439/660 |
| 7,625,243 | B2 * | 12/2009 | Chen et al. | 439/660 |
| 7,833,065 | B2 * | 11/2010 | Lin et al. | 439/639 |
| 8,157,599 | B2 * | 4/2012 | Wei | 439/660 |
| 8,684,752 | B2 * | 4/2014 | Hsueh | 439/79 |

FOREIGN PATENT DOCUMENTS

| | | |
|---|---|---|
| CN | 201570629 | 9/2010 |

* cited by examiner

*Primary Examiner* — Jean F Duverne

(74) *Attorney, Agent, or Firm* — Wei Te Chung; Ming Chieh Chang

(57) ABSTRACT

An electrical connector 100 includes an insulative housing 1, a plurality of contacts 2 retained in the insulative housing 1 and a spacer 3 mounted in the insulative housing 1. The contacts 2 include a plurality of first contacts 210 each having a first extending portion 213 extending downwardly and a plurality of second contacts 220 each having a second extending portion 223 extending downwardly. The first extending portions 213 and the second extending portions 223 form two rows, respectively. The spacer 3 includes a base 31 and a lump 33 extending upwardly from the base 31. The lump 33 separates the first extending portions 213 from the second extending portions 223 along a front-to-rear direction to improve signal transmission quality of the electrical connector 100.

13 Claims, 5 Drawing Sheets

ELECTRICAL CONNECTOR WITH SPACER

BACKGROUND OF THE INVENTION

1. Field of the Invention

The present invention generally relates to an electrical connector and more particularly to an electrical connector with a spacer which is mechanically retained to an insulative housing of the electrical connector.

2. Description of Related Art

Chinese patent No. 201570629U, published on Sep. 1, 2010, discloses an electrical connector including an insulative housing, a plurality of contacts retained in the insulative housing, a spacer mounted to the insulative housing and a shield shell enclosing the insulative housing. The insulative housing includes a body portion and a tongue extending forwardly from the body portion. The spacer has a plurality of through holes passing therethrough. The contacts include a first group of contacts having a plurality of first contacts, and a second group of contacts located under the first group of contacts and having a plurality of second contacts. The first contact includes a first retaining portion retained in the insulative housing, a first extending portion extending downwardly and vertically from a rear of the first retaining portion and into the through hole, and a first soldering portion extending downwardly from the first extending portion and extending out of the through hole downwardly. The second contact includes a second retaining portion retained in the insulative housing, a second extending portion extending downwardly from the retaining portion and into the through hole of the spacer and a second soldering portion extending downwardly from the second extending portion and out of the spacer. The first extending portions are arranged adjacent to the second extending portions. As this result, the heavy cross-talk between the first and second extending portion may occure the data transmission.

So, an improved connector is needed.

SUMMARY OF THE INVENTION

The present invention provides an electrical connector, which comprises an insulative housing, a plurality of contacts received in the insulative housing and a spacer mounted into the insulative housing for retaining the contacts. The contacts include a first group of contacts having a plurality of first contacts and a second group of contacts having a plurality of second contacts. The first contacts each have a first extending portion extending vertically, and the second contacts each have a second extending portion extending vertically. The first and second extending portions are arranged in two rows along a front-to-rear direction. The spacer has a base and a lump extending upwardly from the base. The lump separates the first extending portion from the second extending portion along the front-to-rear direction.

Other objects, advantages and novel features of the present invention will become more apparent from the following detailed description of the present embodiment when taken in conjunction with the accompanying drawings.

DETAILED DESCRIPTION OF THE INVENTION

Figure 1:
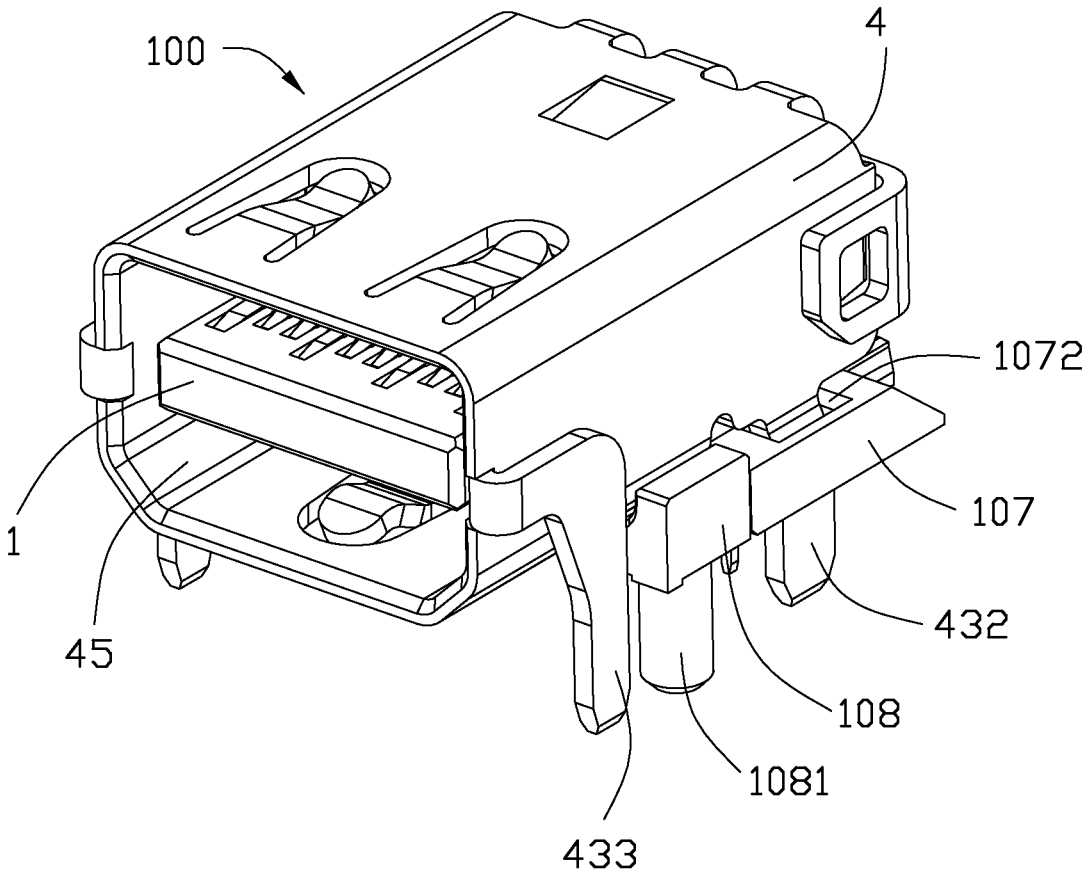
FIG. 1 is an assembled perspective view of an electrical connector according to a preferred embodiment of the present invention.

Reference will now be made to the drawing figures to describe the preferred embodiment of the present invention in detail.

Figure 2:
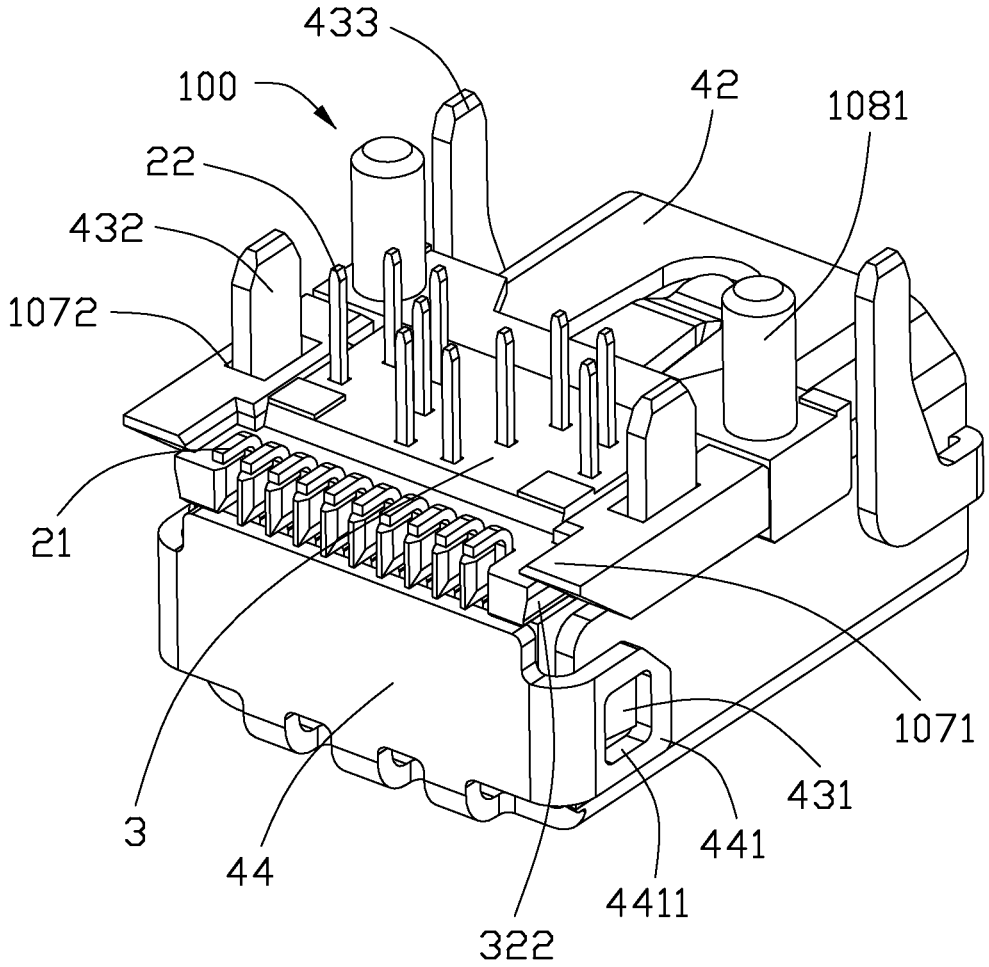
FIG. 2 is another assembled perspective view of the electrical connector as shown in FIG. 1, taken from another side.
Figure 3:
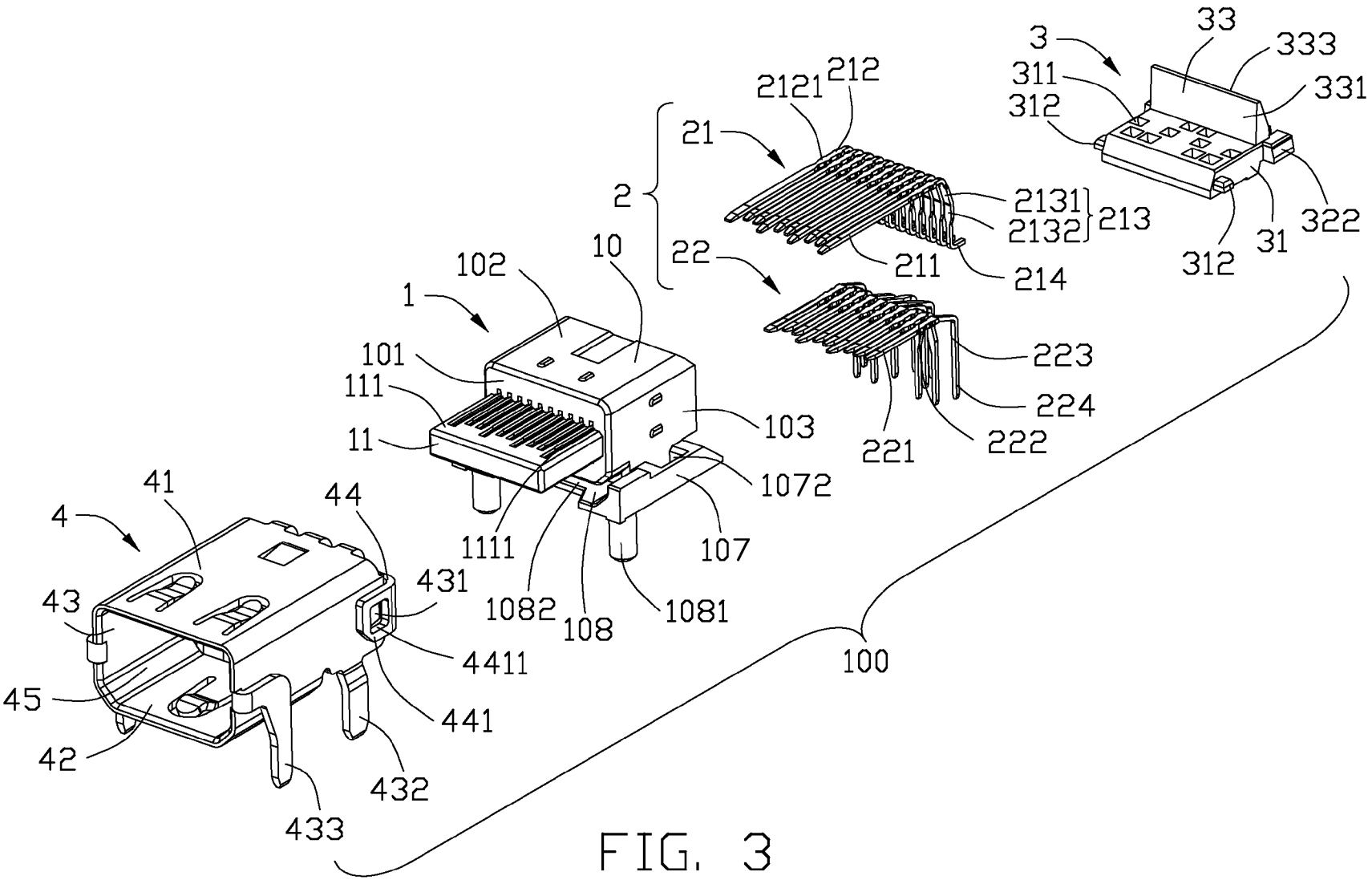
FIG. 3 is an exploded perspective view of the electrical connector.

Referring to FIGS. 1-3, an electrical connector 100 comprises an insulative housing 1, a plurality of contacts 2 received in the insulative housing 1 for electrically contacting with a mating connector (not labeled), a spacer 3 mounted onto a rear of the insulative housing 1 for retaining the contacts 2 and a metal shell 4 enclosing in the insulative housing 1.

Figure 4:
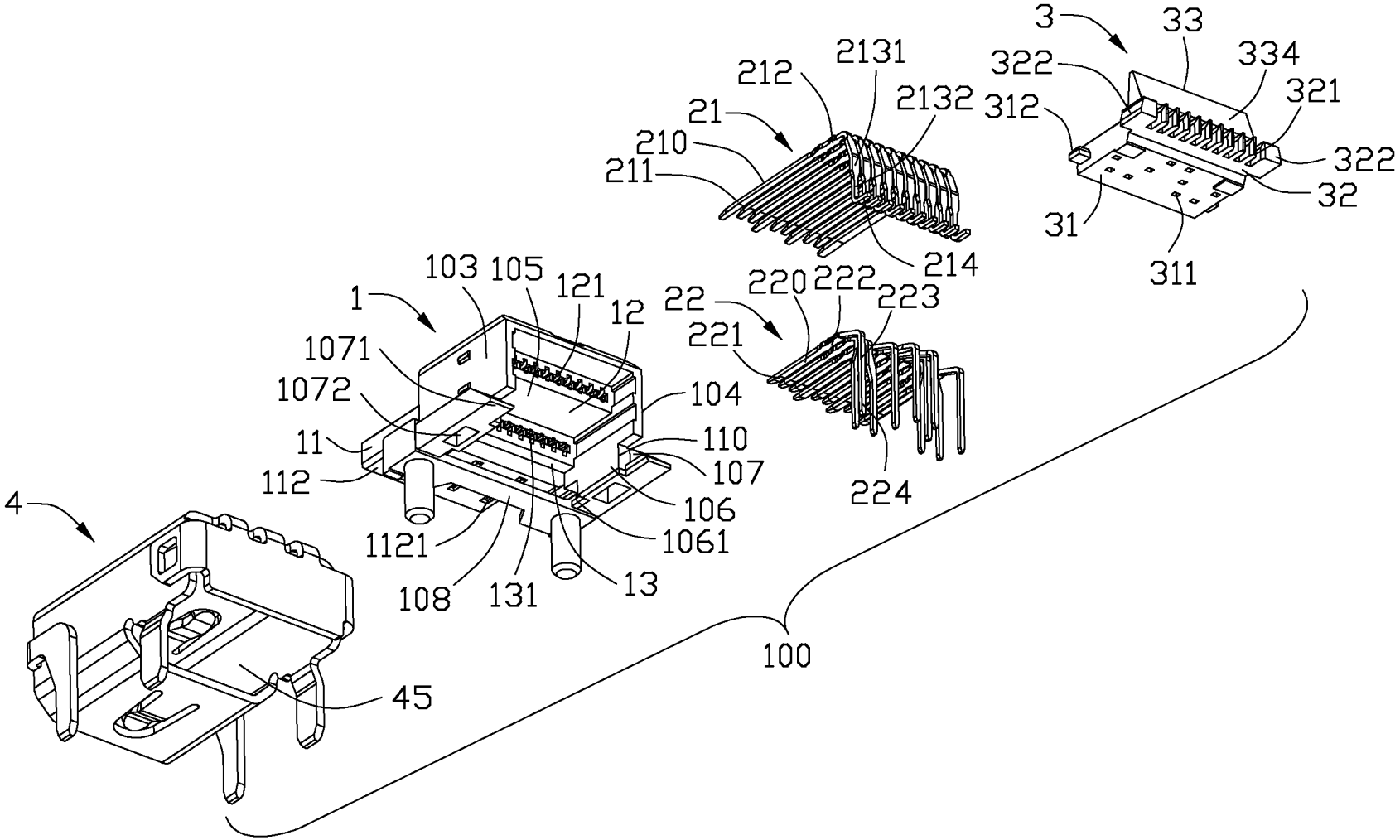
FIG. 4 is another exploded view of the electrical connector as shown in FIG. 3.

Referring to FIGS. 3-4, the insulative housing 1 includes a body portion 10 and a tongue 11 extending forwardly from the body portion 10. The body portion 10 comprises a front wall 101, a top wall 102, a left wall 103 and a right wall 104 extending downwardly from two sides of the top wall 102, these walls 101, 102, 103, 104 cooperatively surround a receiving space 105. The receiving space 105 passes through the body portion 10 downwardly and backwardly. The insulative housing 1 further includes a first step 12 backwardly extending into the receiving space 105 and a second step 13 extending downwardly from a front of the first step 12. The first step 12 extends backwardly beyond the second step 13. The tongue 11 comprises an upper surface 111 and a bottom surface 112 opposite to the upper surface 111. The upper surface 111 of the tongue 11 has a plurality of the first receiving slots 1111 depressed downwardly thereof. The bottom surface 1112 of the tongue 11 has a plurality of second receiving slots 1121 depressed upwardly thereof.

The first step 12 has a plurality of first receiving passageway 121 passing therethrough along a front-to-rear direction and be communicated with the first receiving slot 1111. The second step 13 has a plurality of second receiving passageway 131 passing therethrough along the front-to-rear direction and be communicated with the second receiving slot 1121. The left and right wall 103, 104 each have a protruding portion 106 extending downwardly therefrom and a positioning block 107 extending outwardly from the protruding portion 106 and beyond the left and right walls 103, 104. Each positioning block 107 has a mounting hole 1072 passing therethrough along an upper-to-down direction. The protruding portion 106 has a retaining slot 1061 passing through the protruding portion 106 downwardly and inwardly. The positioning block 107 has a plating portion 1071 extending horizontally therefrom. An attaching space 110 is formed between the plating portions 1071 and the left and right walls 103, 104 and behind the protruding portion 106. A supporting portion 108 extends forwardly from a bottom edge of the front wall 101 and connects with front edges of the two plating portions 1071. The supporting portion 108 has a pair of positioning posts 1081 extending downwardly therefrom. A retaining space 1082 is formed between the supporting portion 108 and the body portion 10.

Figure 5:
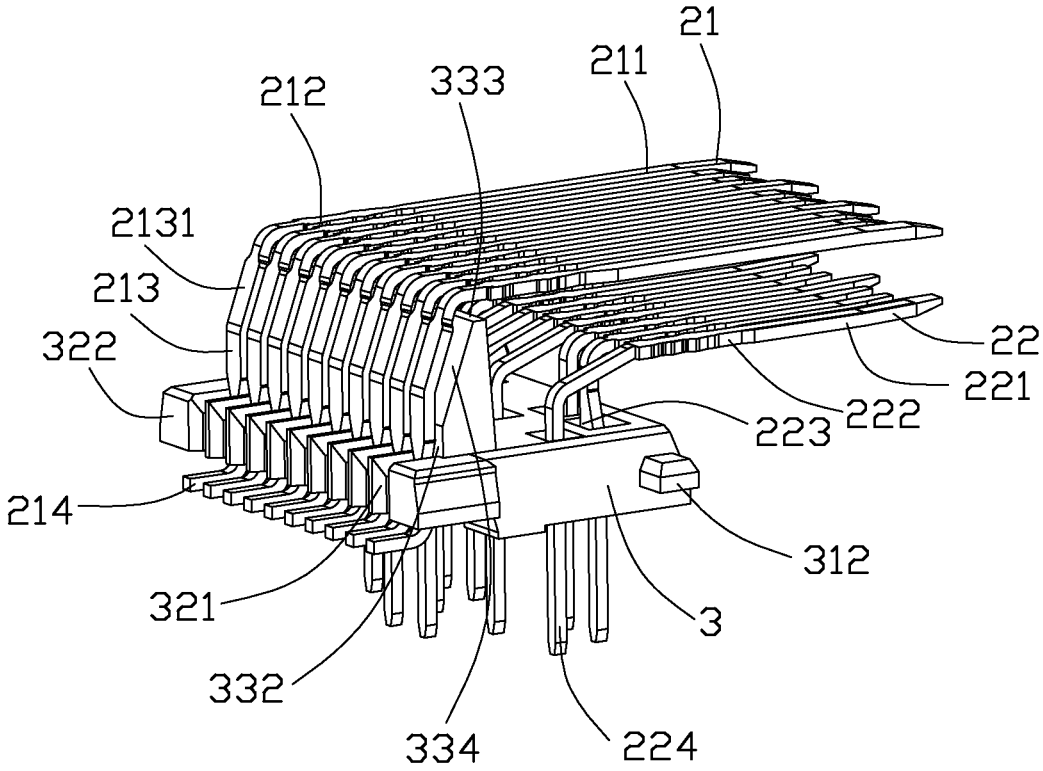
FIG. 5 is a perspective view of a plurality of contacts of the electrical connector mounted in a spacer of the electrical connector according to a preferred embodiment of the present invention.

Referring to FIG. 5, the spacer 3 includes a horizontal base 31, a lump 33 extending upwardly from a rear of the base 31 and a positioning portion 32 extending backwardly from the base 31. The lump 33 includes a front surface 331, a rear surface 332 perpendicular to the base 31, a horizontal top surface 333 and an aslant surface 334 connecting the top surface 333 and the front surface 331. The lump 33 extends from a left edge of the spacer 3 to a right edge of the spacer 3. A width of a top of the lump 33 along the front-to-rear direction is narrower than a width of a bottom of the lump 33 to make the cross section of the lump to be a trapezoidal shape.

The base 31 has a plurality of through holes 311 passing therethrough and a pair of latching blocks 312 extending outwardly from two sides thereof. The positioning portion 32 has a plurality of retaining slots 321 depressed forwardly from a rear thereof and passing therethrough along the upper-to-down direction and a pair of mounting portions 322 extending outside from two sides thereof.

The spacer 3 is mounted to the receiving space 105 of the insulativer housing 1 along the down-to-upper direction. The base 31 abuts against a rear of the front wall 101 of the insulative housing 1 forwardly. The lump 33 resists a rear of the first step 12 upwardly. The latching blocks 312 are received in the retaining slots 1061 and the mounting portion 322 is received in the attaching space 110. The mounting portion 322 is located between the plating portion 1071 and the left and right walls 103, 104. A front of the base 31 of the spacer 3 is received in the retaining space 1082 partly.

Referring to FIGS. 2-5, the contacts 2 include a first group of contacts 21 and a second group of contacts 22 located under the first group of contacts 21. The first group of contacts 21 includes a plurality of first contacts 210 each having a first retaining portion 212 retained in the first receiving passageway 121, a first contacting portion 211 extending forwardly from the first retaining portion 212 and retained in the first receiving slot 1111, a first extending portion 213 extending downwardly and bent from a rear of the retaining portion 212 and a first soldering portion 214 extending backwardly and vertically from the extending portion 213. The first retaining portion 212 is disposed upon the lump 33 of the spacer 3 and the first extending portion 213 is located behind the lump 33. The first extending portion 213 includes an aslant portion 2131 extending downwardly and aslant from a rear of the first retaining portion 212 and located behind the lump 33 of the spacer 3, and a latching portion 2132 extending downwardly and vertically from the aslant portion 2131 and connecting the rear surface 332 of the lump 33 with the first soldering portion 214. The latching portion 2132 is located behind the rear surface 332 of the lump 33. The first soldering portion 214 extends backwardly and horizontally from the latching portion 2132 for surface mounting to a printed circuit board. The latching portion 2132 is narrower than the aslant portion 2131. The latching portion 2132 is received in the retaining slots 321 of the spacer 3. The first soldering portion 214 extends backwardly beyond the positioning portion 32 of the spacer 3. The first retaining portion 212 has a plurality of first lances 2121 extending outwardly from two sides thereof.

The second group of contacts 22 includes a plurality of second contacts 220. The second contacts 220 each have a second retaining portion 222 retained in the second receiving passageway 131, a second contacting portion 221 extending forwardly from the retaining portion 222 and received in the second receiving slot 1121, a second extending portion 223 extending backwardly and vertically from a rear of the second retaining portion 222 and extending into the through hole 311 of the spacer 3, and a second soldering portion 224 extending downwardly from the extending portion 223 and extending out of the through hole 311. The second retaining portions 222 are arranged in a row along a transverse direction and the second extending portions 223 are arranged in three rows along an inserting direction. The second group of contacts 22 is disposed in the front of the lump 33 of the spacer 3. The first extending portion 213 is located in the rear of the lump 33 and the second extending portion 223 is located in the front of the lump 33 respectively. The height of the second retaining portion 222 is lower than the height of the lump 33 along the upper-to-down direction. The lump 33 separates the second contacts 220 from the first contacts 210 along the front-to-rear direction.

The shield shell 4 encloses around the insulative housing 1 and is made by a metal plate. The shell 4 includes a top face 41, a bottom face 42 opposite to the top face 41, two side faces 43 connecting the top face 41 and the bottom face 42 and a back cover 44 extending downwardly and vertically from the top face 41, which cooperatively surround an inserting space 45. The side face 43 has a limiting block 431 extending outside thereof and a first retaining tail 432 extending downwardly from a rear thereof. The first retaining tail 432 is located behind the bottom face 42. The side face 43 has a second retaining tail 433 backwardly then extending downwardly and vertically from a front thereof. The second retaining tail 433 abuts against the out side of the side face 43. The back cover 44 has a pair of the locking portions 411 extending forwardly and vertical from two sides thereof. The locking portion 411 has a latching slot 4111 passing therethrough. The latching slot 4111 abuts against the side face 43. The limiting block 431 is received in the latching slot 4411. The insulative housing 1 is mounted into the shell 4 along the rear-to-front direction, and the tongue 11 extends into the inserting space 45. The supporting portion 108 resists the bottom face 43 of the shell 4 upwardly and the back cover 44 resists the rear of insulative housing 1. The first retaining tail 432 extends through the mounting hole 1072 downwardly.

The electrical connector 100 comprises a spacer 3 having a lump 33 extending upwardly thereof. The lump 33 separates the adjacent first and second groups of contacts 21, 22 from each other along the front-to-rear direction to improve signal transmission quality of the electrical connector 100.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing;

a plurality of contacts received in the insulative housing, the contacts comprising a first group of contacts having a plurality of first contacts and a second group of contacts having a plurality of second contacts, the first contact having a first extending portion extending downwardly and the second contact having a second extending portion extending downwardly, the first and second extending portions arranged in two rows, respectively and along a front-to-rear direction;

a spacer mounted into the insulative housing to retain the contacts, the spacer having a base and a lump extending upwardly from the base, the lump separating the first extending portion from the second extending portion along the front-to-rear direction; wherein the lump has an opposite front and rear surfaces perpendicular to the base, a horizontal top surface and an aslant surface connecting the top surface with the rear surface; wherein the first contacts each include a first retaining portion retained in the insulative housing, the first extending portion extends downwardly from a rear of the retaining portion, the first retaining portion is located upon the lump, the second contacts each include a second retaining portion retained in the insulative housing, the second extending portion extends downwardly from the second retaining portion, the first retaining portions are arranged in a row and located under the top surface of the lump, the second retaining portions are arranged in another row and parallel to the row of the first retaining portions; wherein the first extending portion includes an aslant portion extending downwardly and aslant from a rear of the first retaining portion and a latching portion extending downwardly and vertically from the aslant portion, the latching portion is narrower than the aslant portion, the aslant portion is located behind the aslant surface of the spacer.

2. The electrical connector as claimed in claim 1, wherein the lump substantially extends through the spacer from a left edge of the spacer to a right edge of the spacer.

3. The electrical connector as claimed in claim 1, wherein a width of a top of the lump along the front-to-rear direction is narrower than a width of a bottom of the lump to make the cross section of the lump a trapezoidal shape, the first extending portion is located behind the rear surface and the second extending portion abuts against the top surface along an upper-to-down direction.

4. The electrical connector as claimed in claim 1, wherein the first extending portion includes an aslant portion extending downwardly and aslant from a rear of the first retaining portion and a latching portion extending downwardly and vertically from the aslant portion, the latching portion is narrower than the aslant portion, the aslant portion is located behind the aslant surface of the spacer.

5. The electrical connector as claimed in claim 4, wherein the spacer includes a base and a positioning portion extending from a rear of the base, the positioning portion has a plurality of retaining slots passing therethrough, the first latching portions of the first contacts are received in the retaining slots, the base has a plurality of through holes passing therethrough, and the second extending portions are received in the through holes.

6. The electrical connector as claimed in claim 2, wherein the insulative housing includes a body portion having a front wall, a top wall, a left wall and a right wall, the left and right walls each include a protruding portion extending downwardly from a front thereof and a positioning block extending outwardly from the protruding portion, the positioning block has a plating portion extending backwardly therefrom and a retaining slot passing through downwardly and an inner side thereof, an attaching space is formed between the plating portions and the left and right walls, the base has a pair of latching blocks extending outwardly from two sides thereof and the latching block is received in the retaining slot, the positioning portion of the spacer has a mounting portion extending outwardly therefrom and the mounting portion is received in the attaching space.

7. The electrical connector as claimed in claim 6, further comprises a shield shell enclosing the insulative housing, the shell includes a top face, a bottom face and two side faces connecting the top and bottom faces, the side faces each have a first retaining tail extending downwardly from a rear thereof, the positioning block has a mounting hole passing therethrough and the first retaining tail passes downwardly through the mounting hole.

8. The electrical connector as claimed in claim 7, wherein the insulative housing includes a supporting portion extending forwardly from a rear edge of the top wall and connecting the plating portions.

9. An electrical connector comprising:

an insulative housing;

a spacer mounted into the insulative housing, the spacer having a base having a plurality of through holes and a plurality of retaining slots defined on a rear thereof and a lump extending upwardly from the base, the lump located between the retaining slots and through holes;

a plurality of contacts received in the insulative housing, the contacts comprising a first group of contacts having a plurality first contacts and a second group of contacts having a plurality of second contacts, the first contact having a first extending portion, and the second contact having a second extending portion, the lump separating the first extending portion from the second extending portion along a front-to-rear direction; wherein the lump has an opposite front and rear surfaces perpendicular to the base, a horizontal top surface and an aslant surface connecting the top surface with the rear surface; wherein a width of a top of the lump along the front-to-rear direction is narrower than a width of a bottom of the lump to make the cross section of the lump a trapezoidal shape, the first extending portion is located behind the rear surface and the second extending portion abuts against the top surface along an upper-to-down direction.

10. The electrical connector as claimed in claim 9, wherein the lump extends from a left edge of the spacer to a right edge of the spacer.

11. The electrical connector as claimed in claim 9, wherein the first contact includes a first soldering portion extending backwardly and horizontally from the first extending portion, the second contact includes a second soldering portion extending downwardly from the second extending portion.

12. An electrical connector for mounting to a printed circuit board, comprising:

an insulative housing defining a mating port in a front portion and a mounting port in a rear portion in a front-to-back direction;

a plurality of upper and lower contacts disposed in the housing, each of said upper and lower contacts defining a front contacting section around the mating port, and a rear mounting section around the mounting port;

an insulative spacer located in the mounting port and defining a front area with a plurality of through holes to receive vertical sections of corresponding tails of the lower contacts for through hole type mounting to the printed circuit board, respectively, and a rear area with a row of rearward slots to receive vertical portions of corresponding tails of the upper contacts while tips of the corresponding tails extend rearwardly horizontally under said spacer for surface mounting to the printed circuit board; wherein said space further defines an upward extending lump between the front area and the rear area, and a portion of the tail of each of the corresponding upper contacts above the corresponding tail portion, forwardly abuts against a rear surface of the lump so as to have the spacer upwardly assembled to the housing in a vertical direction perpendicular to said front-to-back direction either before or after the upper contacts have been forwardly loaded into the housing in said front-to-back direction; wherein the slots in the rear area are arranged in only one row in a transverse direction perpendicular to both said front-to-back direction and said vertical direction, while the through holes in the front area are arranged in two rows each extending in the transverse direction while both being spaced from each other in the front-to-back direction; wherein in the mounting port, the housing defines an upper step structure to hold the upper contacts, a lower step structure to hold the lower contacts therein, and the upper step structure downward directly faces the front area of the space and the tails of the lower contacts and is dimensioned similar to the front area of the spacer in a front-to-back direction.

13. The electrical connector as claimed in claim 12, wherein the rear surface of the lump is slant, and in each of said upper contacts said portion above the vertical portion slanting abuts against said rear surface.

* * * * *